US007588443B2

(12) United States Patent
Wu et al.

(10) Patent No.: US 7,588,443 B2
(45) Date of Patent: Sep. 15, 2009

(54) BOARD-TO-BOARD ELECTRICAL CONNECTOR ASSEMBLY

(75) Inventors: Chun-Kwan Wu, Tu-Cheng (TW); Tien-Chieh Su, Tu-Cheng (TW); Chia-Wei Wu, Tu-Cheng (TW); Ming-Tsung Chiang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/890,869

(22) Filed: Aug. 8, 2007

(65) Prior Publication Data

US 2008/0038939 A1 Feb. 14, 2008

(30) Foreign Application Priority Data

Aug. 8, 2006 (CN) ..... 2006 2 0076277

(51) Int. Cl.
*H01R 12/00* (2006.01)

(52) U.S. Cl. ..... 439/74

(58) Field of Classification Search ..... 439/74, 439/660, 346, 78, 862, 65, 83, 357, 350
See application file for complete search history.

(56) References Cited

U.S. PATENT DOCUMENTS 5,876,217 A * 3/1999 Ito et al. ..... 439/74
5,928,003 A * 7/1999 Kajinuma ..... 439/74
5,931,689 A * 8/1999 Patel ..... 439/346
6,729,890 B2 * 5/2004 Shin ..... 439/74
6,923,659 B2 * 8/2005 Zhang et al. ..... 439/74
7,090,508 B1 * 8/2006 Chen ..... 439/74
7,172,434 B2 * 2/2007 Obikane et al. ..... 439/74
7,247,029 B2 * 7/2007 Chen ..... 439/66
7,278,861 B2 * 10/2007 Kishi et al. ..... 439/74
7,320,605 B2 * 1/2008 Chang et al. ..... 439/74
2004/0063344 A1 * 4/2004 Shin ..... 439/74
2006/0178022 A1 * 8/2006 Liu ..... 439/74
2006/0264074 A1 * 11/2006 Chang et al. ..... 439/74

* cited by examiner

*Primary Examiner*—Neil Abrams
*Assistant Examiner*—Harshad C Patel
(74) *Attorney, Agent, or Firm*—Wei Te Chung

(57) ABSTRACT

A board-to-board connector assembly includes a first connector (100) having a first housing (10) defining two opposite first longitudinal peripheral walls (11*a*) and two opposite first transverse peripheral walls (11*b*) connecting the first longitudinal walls. A rib (114) and a locking portion (116) are respectively defined in corresponding inner wall of the first longitudinal and transverse peripheral walls. A second connector (200) comprises a second housing (30), a plurality of terminals (40) received in the second housing and a pair of metal ears (50) engaged with two opposite second peripheral walls. The terminal and the metal ear respectively define a protrusion (431) and a projection (54) extending outward thereof and snugly fit against the corresponding rib and the locking portion when the first and second connectors engage with each other.

10 Claims, 7 Drawing Sheets

BOARD-TO-BOARD ELECTRICAL CONNECTOR ASSEMBLY

BACKGROUND OF THE INVENTION

1. Field of the Invention

The present invention relates to electrical connectors, especially to an electrical connector assembly provided for electrically connection between two circuit boards.

2. Description of Related Art

A variety of electrical connectors have been used to make electrical connections between the circuits on different printed circuit boards. These printed circuit boards must be joined together with connectors in a manner to effectively and reliably interconnect the circuits on one circuit board to the circuits on another circuit board. This is done by a pair of mating connectors which are surface mounted connectors and may include a male or plug connector mateable with a female or receptacle connector to form a board-to-board electrical connector assembly.

As stated above, both connectors of the electrical connector assembly are surface mounted connectors. Both connectors typically have a low profile and have some form of mechanism to hold the connectors together. The holding mechanism preferably aligns the connectors, prevents the two connectors from wobbling and maintains the terminals of the connector in good, positive interengagement.

WO Publication No. 2004-10538 A1 discloses a conventional board-to-board connector assembly comprising a first connector engaged with a first PCB, a second connector engaged with the first connector and a second PCB. The first connector comprises a first housing and a plurality of first terminals received in the first housing. The second connector comprises a second housing and a plurality of second terminals received in the second housing. The first terminal is formed a single metallic sheet by stamping and curving. The first terminal comprises an integral spring portion, an inverted U-shaped retaining portion and a soldering portion. The retaining portion defines a first wall, a top portion, a second wall, a first curved portion formed between the first wall and the top portion, and a second curved portion formed between the top portion and the second wall. The second terminal is formed a single metallic sheet by crimping and has a P-shaped cross-sectional configuration. The second terminal comprises a first contacting portion defined a protrusion thereof, a second contacting portion, a top end and a tail portion. When the first and second connectors are assembled each other, the first terminal of the first connector is electrically engaged with the second terminal of the second connector. At this time, the protrusion of the second terminal fixedly locked under a bottom end of the second curved portion of the first terminal and electrically connecting with the second wall of the retaining portion so as to obtain reliable orientation between the first and second connectors.

However, because the first terminal is formed a single metallic sheet by stamping and curving, which make the configuration of the first terminal and manufacture of the first terminal are so complicated. Furthermore, when the first connector engages with the second connector, the orientation between the first and second connectors is only obtained by the engagement between the first and second terminals. Which is insufficient to prevent the first and second connectors from wobbling.

Therefore, an improved board-to-board connector assembly is desired to overcome the disadvantages of the prior arts.

SUMMARY OF THE INVENTION

An object of the present invention is to provide a board-to-board connector assembly for effecting a connection between two circuit boards.

In order to achieve above-mentioned object, an board-to-board connector assembly in accordance with a preferred embodiment of the present invention comprises a first connector and a second connector engaged with the first connector. The first connector comprises a first insulative housing, a plurality of first terminals received in the housing and four first metal ears engaged with corresponding corners of the first housing. The first housing defines a first peripheral wall defining a first opposite longitudinal walls and a second opposite transverse walls connecting with the first longitudinal walls, a main body formed in a middle portion thereof around the first peripheral wall, and two engagement passages formed between the first peripheral wall and the main body. The first longitudinal wall defines a plurality of passageways therethrough, while main body defines a plurality of mounting holes therethrough and connected with the engagement passages. The first terminal comprises a first tail, a first retaining portion secured in the passageway and a first contacting portion received in the mounting hole.

The second connector comprises a second insulative housing, a plurality of second terminals received in the housing and a pair of second metal ears engaged with two opposite ends of the housing. The peripheral wall defines a second peripheral wall a second opposite longitudinal walls and a second opposite transverse walls connecting with the second longitudinal walls, and a receiving cavity formed between the second longitudinal and transverse walls. The second longitudinal wall defines a plurality of receiving holes therethrough. The second terminal comprises a second retaining portion, a second contacting portion, a connecting portion connecting the second retaining portion and the second contacting portion, and a second tail soldered onto a printed circuit board. The second terminal also defines a protrusion formed between the connecting portion and the second retaining portion, while the second metal ear defines a block thereof. The first peripheral wall defines a rib and a locking portion on its inner portion toward to the engagement passage, respective engaged with corresponding to the protrusion and the block of the second connector during the first and second connectors engaged each other.

Other objects, advantages and novel features of the present invention will become more apparent from the following detailed description of the present embodiment when taken in conjunction with the accompanying drawings.

DETAILED DESCRIPTION OF THE INVENTION

Figure 1:
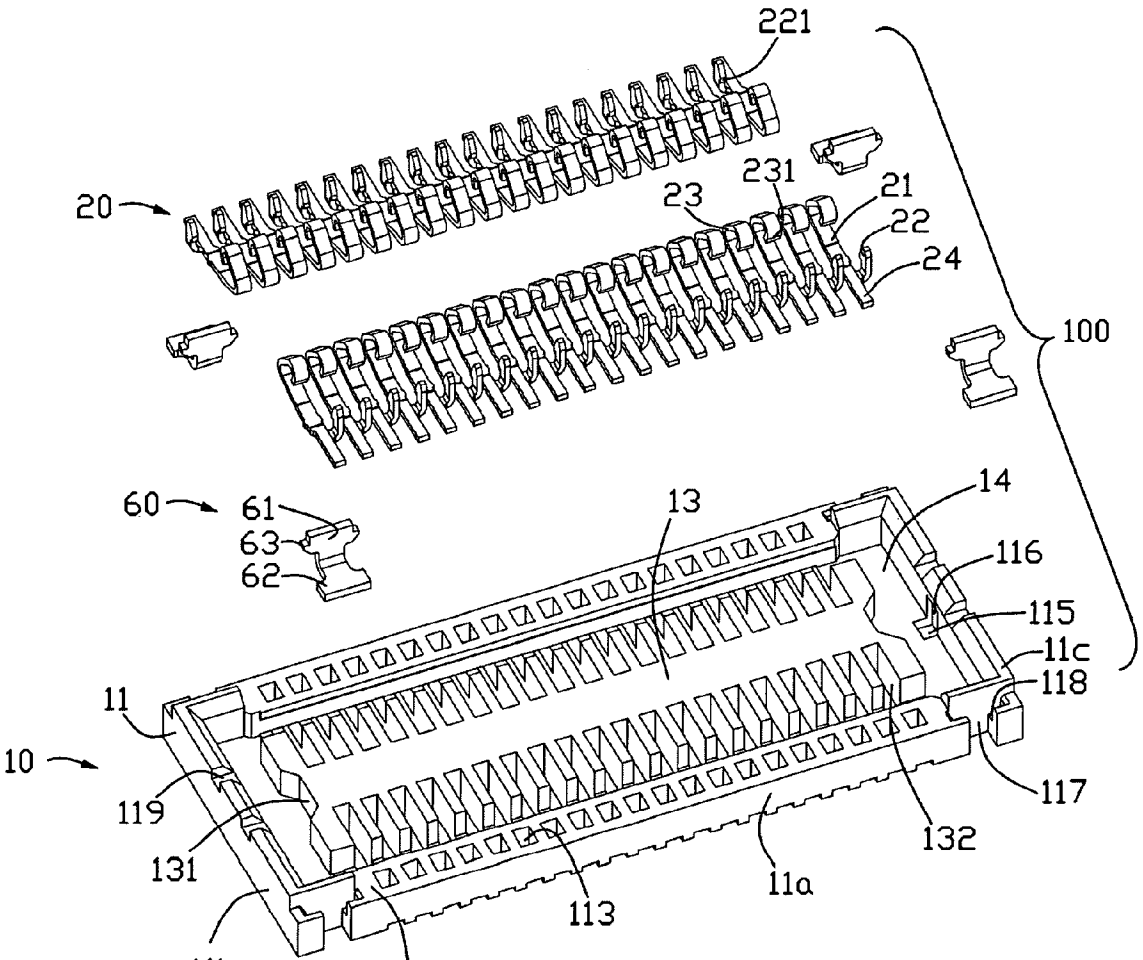
FIG. 1 is an exploded, perspective view of a first connector of the connector assembly in accordance with the preferred embodiment of the present invention.

Reference will now be made to the drawing figures to describe the preferred embodiment of the present invention in detail.

Referring to FIGS. 1-7, a board-to-board electrical connector assembly provided for electrical connection between a first and second printed circuit board (PCBs) (not shown) in accordance with the preferred embodiment of the present invention comprises a first connector 100 and a second connector 200 engaged with the first connector 100.

Figure 2:
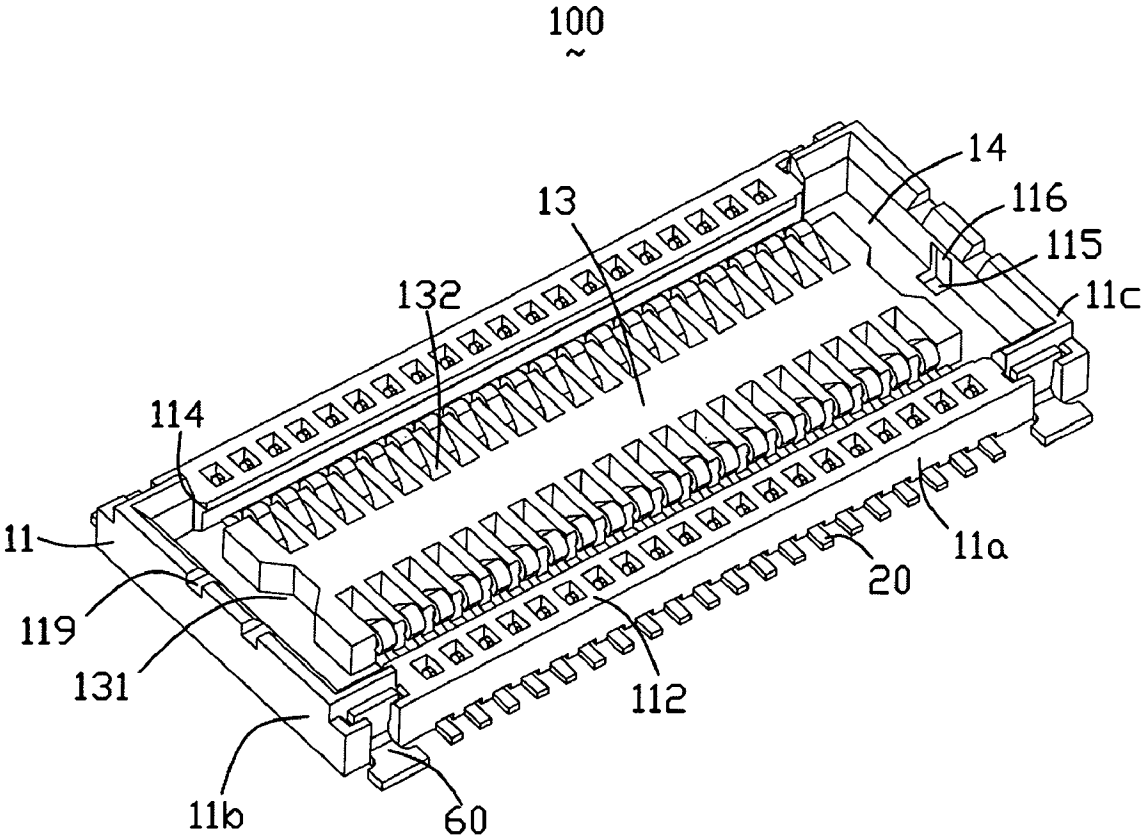
FIG. 2 is an assembly view of the first connector of FIG. 1.

Referring to FIGS. 1 and 2, the first connector 100 comprises a first housing 10, a plurality of first terminals 20 received in the first housing 10 and four first metal ears 60 engaged with the first housing 10. The first housing 10 comprises a first peripheral wall 11, a rectangular main body 13 formed in a middle portion thereof around the first peripheral wall 11, and an engagement passage 14 formed between the first peripheral wall 11 and the main body 13. The first peripheral wall 11 defines an opposite first longitudinal walls 11*a* and an opposite first transverse walls 11*b* connecting with the first longitudinal walls 11*a*. The longitudinal wall 11*a* defines a plurality of passageways 113 therethrough and a rib 114 formed on an inner portion thereof toward to the engagement passage 14. The main body 13 defines a pair of trapeziform recesses 131 at two opposite ends parallel to the first transverse wall 11*b*, and a plurality of mounting holes 132 at the other two opposite ends parallel to the first longitudinal wall 11*a*, corresponding to the passageway 113. Both the trapeziform recess 131 and the mounting hole 132 are connected with the engagement passage 14. The first transverse wall 11*b* defines a slot 115 opposite to the trapeziform recess 131 on an inner portion thereof. A locking portion 116 is formed on inner wall of the slot 115, for fixedly engaging with the second terminal 40 of the second connector 200. The first longitudinal wall 11*a* defines a pair of securing recesses 117 at two opposite ends thereof. The securing recess 117 defines a securing portion 118 thereof, for engaging with the first metal ear 60.

Each of the first terminal 20 is formed from a metal sheet by stamping and has an F-shaped cross-sectional configuration. The first terminal 20 comprises a base portion 21 received in the engagement passage 14, a first retaining portion 22 extending upwardly from a lateral side of the base portion 21 for be received in the passageway 113, a first contacting portion 23 extending slantly and upwardly from one end of the base portion 21 and received in the mounting hole 132, and a first tail 24 extending from the opposite end of the base portion 21 for soldering onto the first PCB (not shown). The first retaining portion 22 defines a barb 221 for wedging into the passageway 113. Both the base portion 21 and the first contacting portion 23 are formed a same side of the first retaining portion 22, a connecting point 231 is formed at a distal end of the first contacting portion 23 for engaging with the second terminal 40.

Each first metal ear 60 is engaged with the corresponding securing recess 117 of the first longitudinal wall 11*a* and defines a vertical portion 61 having two fixing legs 63 formed at two opposite ends thereof and provided for engaging with the securing portion 118 of the securing recess 117, a planar portion 62 extending from a bottom end of the vertical portion 61 for soldering the first metal ear onto the first PCB.

When in assembly of the first connector 100, the first terminal 20 is firstly mounted onto the housing 10 from a bottom portion of the housing 10 via the barb 221 of the first retaining portion 22 of the terminal 20 wedging into the corresponding passageway 113 of the housing 10, at the same time, the first tail 24 of the first terminal 20 is extended outward of the peripheral wall 11 of the housing 10. Then the four first metal ears 60 are respectively fixed onto the housing 10 via the corresponding the fixing legs 63 interferentially engaged into corresponding securing portions 118 so as to fix the metal ears 60 into the securing recesses 117, while the planar portion 62 of the first metal ear 60 is also extended outward of the peripheral wall 11 of the housing 10, together with the first tail 24 of the first terminal 20, to solder the first connector 100 onto the first PCB. Thus, electrical connection between the first connector 100 and the first PCB is obtained.

Figure 3:
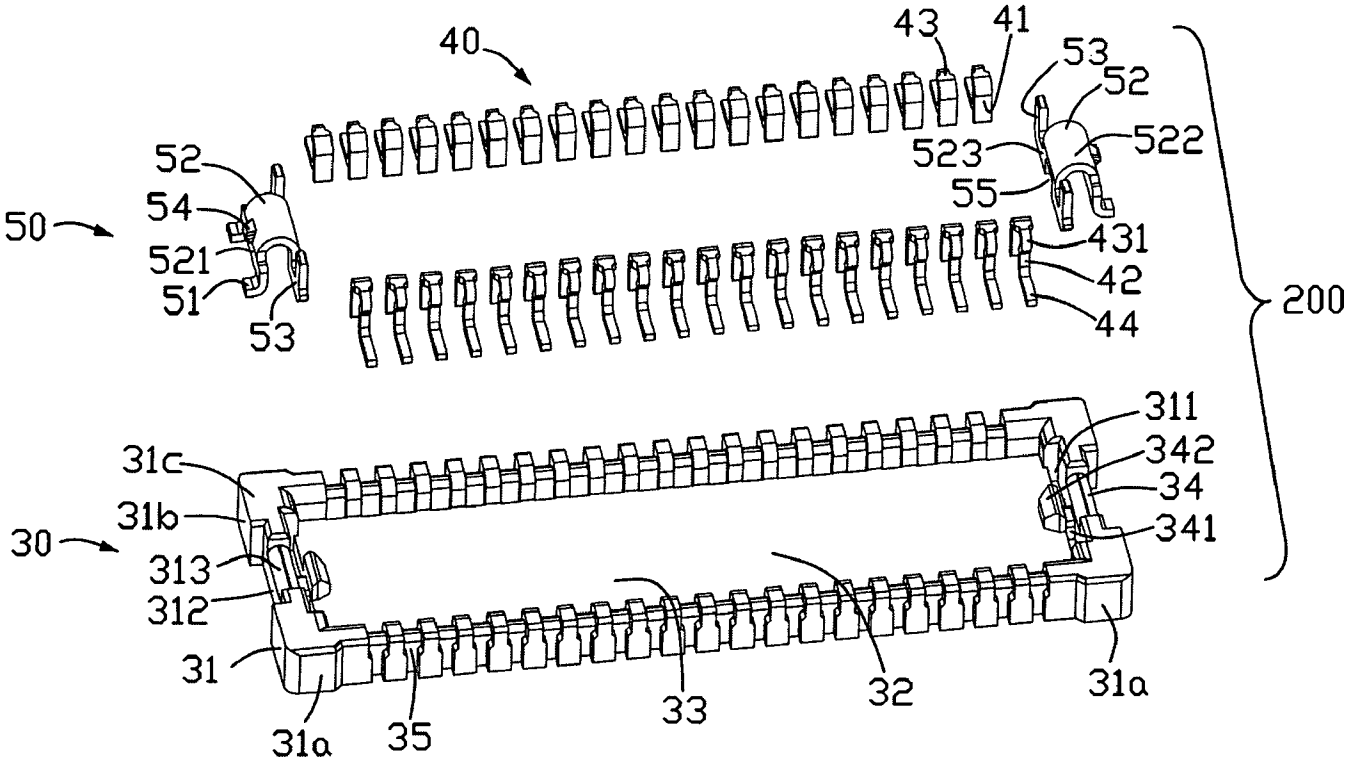
FIG. 3 is an exploded, perspective view of a second connector of the connector assembly in accordance with the preferred embodiment of the present invention.
Figure 4:
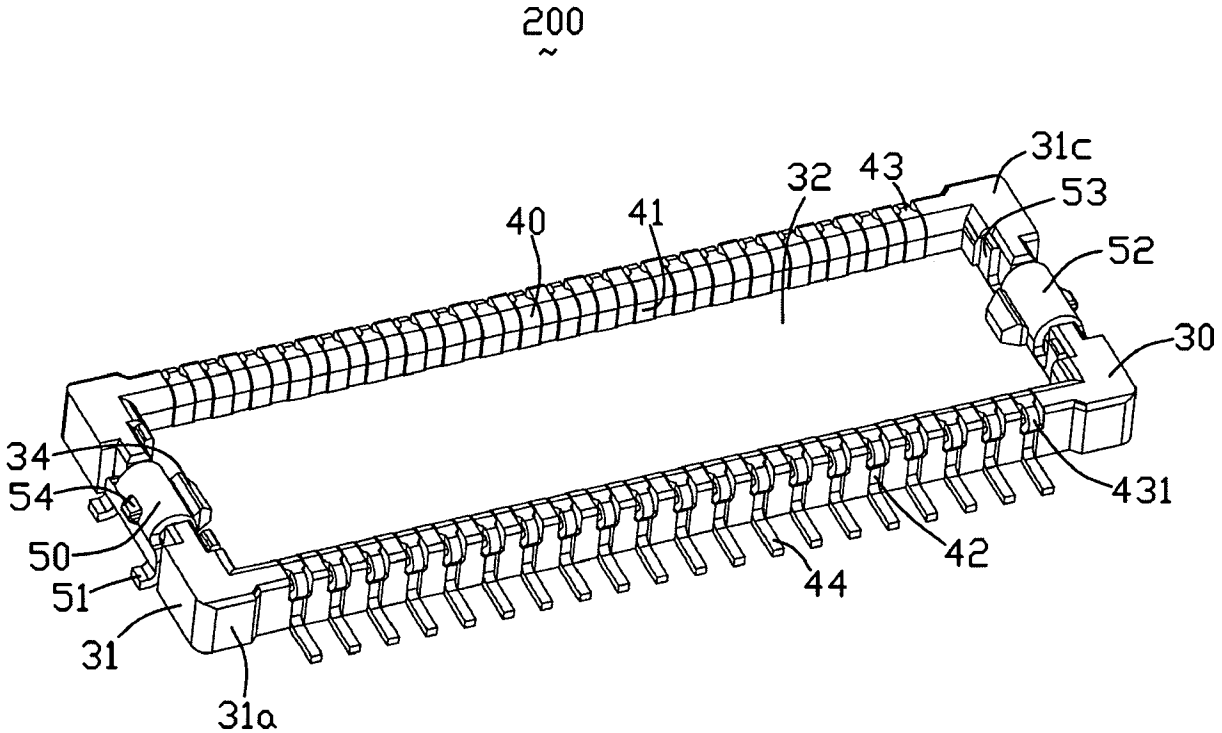
FIG. 4 is an assembly view of the second connector of FIG. 3.

Referring to FIGS. 3 and 4, the second connector 200 comprises a second housing 30, a plurality of second terminals 40 received in the second housing 30 and a pair of second metal ears 50 engaged with the second housing 30. The second housing 30 defines a second peripheral wall 31, a base plate (not shown), and a receiving cavity 33 formed between the peripheral wall 31 and the base plate. The second peripheral wall 31 defines an opposite second longitudinal walls 31*a* and an opposite second transverse walls 31*b* connecting with the second longitudinal walls 31*a*. Each of the second longitudinal walls 31*a* defines a plurality of grooves 35 along a longitudinal direction thereof. The second transverse wall 31*b* defines a cutout 311 connecting with the receiving cavity 33 in its inner wall thereof. A T-shaped flange 34 extends from a middle portion of the cutout 311 toward to the receiving cavity 33 and defines a trapeziform portion 342 formed at a front end of the flange 34. A space 341 is formed between the flange 34 and the inner wall of the cutout 311. The second transverse wall 31*b* defines a pair of notches 312 corresponding to the cutout 311 on an out wall thereof and a channel 313 connected with the cutout 311 and the notch 312 to fix the second metal ear 50 onto the second housing 30.

Each of second terminal 40 has a P-shaped cross-sectional configuration. The second terminal 40 comprises a second contacting portion 41, a second retaining portion 42 parallel to the second contacting portion 41, a connection portion 43 connecting the second contacting portion 41 and the second retaining portion 42, and a second tail 44 extending parallel from an end of the second retaining portion 42. A U-shaped configuration is formed between the second contacting portion 41 and the second retaining portion 42. A protrusion 431 is formed on a junction connecting the second retaining portion 42 and the connection portion 43 and provided for engaging with the rib 114 of the first housing 10 to secure the first and second connectors 10, 30 together.

Each of second metal ear 50 is formed a metal sheet by stamping and comprises a solder 51, an U-shaped portion 52 engaged onto the second transverse wall 31*b* from the cutout 311 to the notch 312, and a pair of mounting portions 53 extending from two lateral ends of the U-shaped portion 52 and received in the cutout 311. The U-shaped portion 52 defines a first wall 521, a second wall 523 and a connecting wall 522 connecting the first and second walls 521, 523. A projection 54 is extended outwardly from a middle portion of the first wall 521, and a gap 55 is formed a bottom end of the second wall 523.

When in assembly of the second connector 200, the second terminal 40 is interfrentially fixed into the corresponding groove 35, the second contacting portion 41, the second retaining portion 42 and the connection portion 43 cooperative formed an U-shaped configuration received in the groove 35 and engaged with the second longitudinal peripheral wall 31 *a* to make the second tail 44 extending outward of the longitudinal peripheral wall 31 *a*. At the same time, a space is formed between the protrusion 431 of the second terminal 40 and an inner face of the groove 35.

Figure 5:
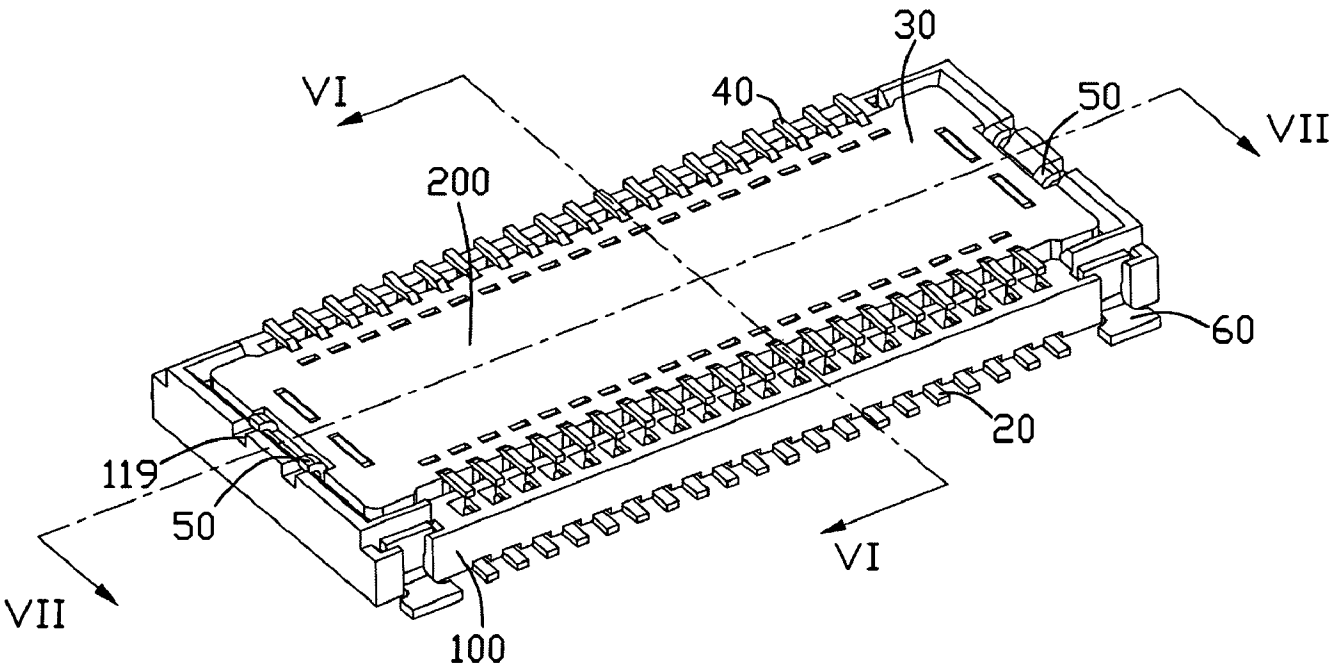
FIG. 5 is an assembly view of the connector assembly.
Figure 6:
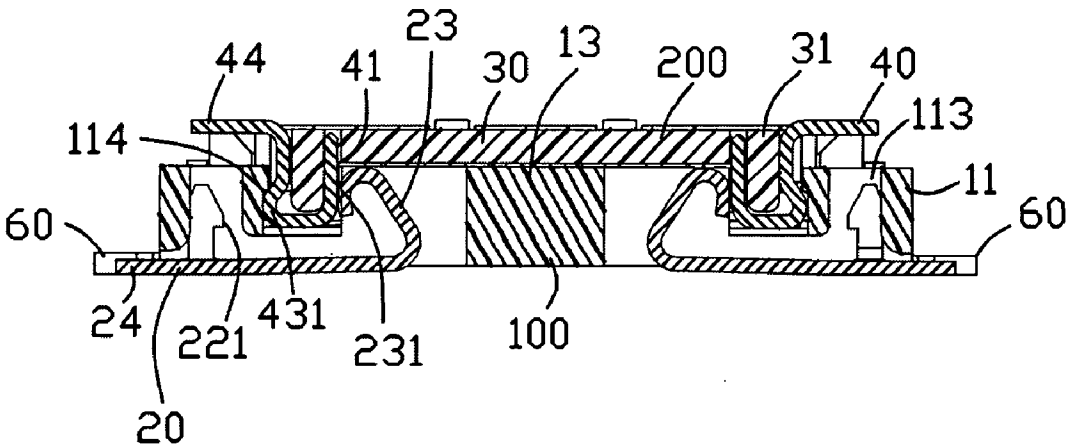
FIG. 6 is a cross-sectional view taken along line VI-VI of FIG. 5.
Figure 7:
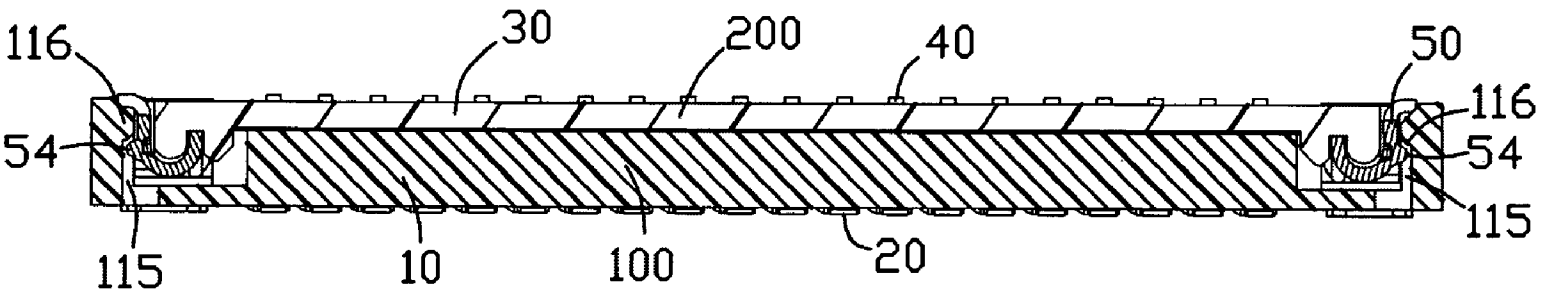
FIG. 7 is a cross-sectional view taken along line VII-VII of FIG. 5.

Referring to FIGS. 5-7, when the first connector 100 is fully mated with the second connector 200 to electrically interconnect each other, the second peripheral wall 31 of the second connector 200 is received in the engagement passage 14, and the trapeziform portion 342 of the flange 34 defined in the second connector 200 is received in the corresponding trapeziform recess 131 of the main body 13 defined in the first connector 100 to make the main body 13 received in the receiving cavity 33. Simultaneously, the connection portion 43 of the second terminal 40 pressly engages with the contacting point 231 of the first terminal 20 at first and engages with the first contacting portion 23 of the first terminal 20 during the second connector 200 ulteriorly engaging with the first connector 100 to make the first contacting portion 23 distortion toward to the main body 13. Thus the contacting point 231 electrically engages with the second contacting portion 41 and reliably conductivity of the first and second connectors 100, 200 is obtained. Furthermore, the protrusion 431 of the second terminal 40 fixedly wedges with the rib 114 of the first housing 10, while the projection 54 of the second metal ear 50 fixedly mounts with the locking portion 116 of the slot 115 of the first housing 10. With these configuration, the first and second connectors 100, 200 can reliably engagement with each other.

However, the disclosure is illustrative only, changes may be made in detail, especially in matter of shape, size, and arrangement of parts within the principles of the invention.

What is claimed is:

1. A board-to-board electrical connector assembly for effecting a connection between two circuit boards, comprising:

a first connector having a first generally rectangular insulative housing defining a pair of first longitudinal peripheral walls and a pair of first transverse peripheral walls connecting with the first longitudinal peripheral walls, the first longitudinal peripheral wall defining a rib in an inner portion thereof and the first transverse peripheral wall also defining a locking portion in an inner portion thereof; and a plurality of first terminals received in the first housing and each terminal defining a tail for connection to an appropriate circuit trace on the first circuit board and a contacting portion exposed generally at the first longitudinal peripheral wall; and a second connector having a second generally rectangular insulative housing defining a plurality of passageways at two opposite second longitudinal walls thereof;

a plurality of second terminals received in corresponding passageways of the second housing and each defining a retaining portion secured in the passageway, a contacting portion for engaging with the contacting portion of the first terminal, a tail for connection to the second circuit board and a connection portion for connecting the retaining portion and the contacting portion of the second terminal, the connection portion defining a protrusion extending outwardly from a lateral side thereof; and a pair of metal ears engaged with two opposite transverse walls of the second housing and each defining a projection extending outwardly from a middle portion thereof; wherein the protrusion of the second terminal and the projection of the metal ear of the second connector are respectively snugly fit against the rib and the locking portion of the first connector.

2. The board-to-board electrical connector assembly as described in claim 1, wherein the first housing defines a main body in a middle portion thereof and an engagement passage formed between the main body and the first peripheral walls.

3. The board-to-board electrical connector assembly as described in claim 2, wherein the first terminal has an F-shaped cross-sectional configuration and comprises a base portion received in the engagement passage, a first retaining portion extending upwardly from a lateral side of the base portion, the contacting portion extending slantly and upwardly from one end of the base portion.

4. The board-to-board electrical connector assembly as described in claim 3, wherein the first connector further comprises two pairs of first metal ears engaging with two opposite ends of the longitudinal peripheral walls, and the first metal ear defines a vertical portion having two fixing legs formed at two opposite ends thereof, a planar portion extending from a bottom end of the vertical portion for soldering onto the first circuit board.

5. The board-to-board electrical connector assembly as described in claim 4, wherein the second housing defines two opposite second transverse peripheral walls connecting the second longitudinal peripheral walls and a receiving cavity formed around the second peripheral walls.

6. The board-to-board electrical connector assembly as described in claim 1, wherein the second transverse wall defines a cutout in communication with the receiving cavity, a T-shaped flange extending from a middle portion of the cutout toward to the receiving cavity and defining a trapeziform portion formed at a front end of the flange, a pair of notches corresponding to the cutout on an out surface of said second transverse wall, and a channel connected with the cutout and the notch to fix the metal ear of the second connector to the second housing.

7. The board-to-board electrical connector assembly as described in claim 6, wherein a space is formed between the flange and the inner wall of the cutout.

8. The board-to-board electrical connector assembly as described in claim 7, wherein each metal ear of the second connector comprises a soldering portion, a U-shaped portion engaged onto the second transverse wall from the cutout to the notch, and a pair of mounting portions extending from two lateral ends of the U-shaped portion and received in the cutout.

9. The board-to-board electrical connector assembly as described in claim 8, wherein the U-shaped portion defines a first wall, a second wall and a connecting wall connecting the first and second walls, with the projection extending outwardly from a middle portion of the first wall, and a gap formed at a bottom end of the second wall.

10. The board-to-board electrical connector assembly as described in claim 9, wherein each second terminal has a P-shaped cross-sectional configuration.

* * * * *